US005210970A

United States Patent [19]

Elmer

[11] Patent Number: 5,210,970

[45] Date of Patent: * May 18, 1993

[54] REMOVABLE TRUCK-MOUNTED ADVERTISING SIGNS AND METHOD

[76] Inventor: William A. Elmer, 1010 Temple Grove Ct., Winter Park, Fla. 32789

[ * ] Notice: The portion of the term of this patent subsequent to Dec. 4, 2009 has been disclaimed.

[21] Appl. No.: 830,563

[22] Filed: Jan. 31, 1992

Related U.S. Application Data

[63] Continuation-in-part of Ser. No. 546,714, Jul. 2, 1990, Pat. No. 5,084,994.

[51] Int. Cl.[5] ..... G09F 21/04

[52] U.S. Cl. ..... 40/591; 40/602; 40/606

[58] Field of Search ..... 40/591, 592, 593, 597, 40/602, 610, 412, 413, 606; 211/87, 88; 224/42.42, 42.45, 42.46

[56] References Cited

U.S. PATENT DOCUMENTS 1,359,492 11/1920 Demuth ..... 40/606 X
2,816,377 12/1957 Hastings ..... 40/591
5,084,994 2/1992 Elmer ..... 40/602 X

*Primary Examiner*—Kenneth J. Dorner
*Assistant Examiner*—J. Bonifanti

[57] ABSTRACT

A rigid aerodynamic advertising member is removably mounted to either the tailgate or vertical side of the bed of a pick-up truck with a mounting bracket coupled to rigid braces attached to the advertising member, with the dimension between the braces being sufficient to insure rigidity while the truck is underway.

12 Claims, 6 Drawing Sheets

REMOVABLE TRUCK-MOUNTED ADVERTISING SIGNS AND METHOD

This application is a continuation-in-part of application Ser. No. 07/546,714, filed Jul. 2, 1990, now U.S. Pat. No. 5,084,994.

BACKGROUND OF THE INVENTION

The present invention relates to advertising signs and message boards which may be removably mounted upon a motor vehicle.

A variety of businesses, particularly in the fast food industry, employ part-time delivery vehicles. Typically, the business will provide the part-time delivery person with a sign which may be easily mounted upon the delivery person's vehicle, but removed at the end of the delivery person's shift and used during the next shift. Examples of roof top-mounted removable advertising signs are disclosed in my earlier U.S. Pat. Nos. 4,667,428; 4,839,975 and D.290,620.

Removable advertising signs of this type may also be removably mounted to the vehicle window. An example of such a product is a fabric "wind sock" advertising sign manufactured by Windword, Inc. of Spokane, Wash.

Other prior art of interest is set forth in the following U.S. Pat. Nos.: 914,775 to Aarons; 2,675,983 to King; 3,153,294 to Hay et al; 3,284,938 to Diehl et al; 3,715,821 to Hawes; 3,828,455 to Bentley; 4,231,501 to Goode; 4,667,428 to Elmer; and 4,976,410 to Tomaivolo. See also U.K. Patent 2,124,008 to McGill.

Many of the part-time delivery vehicles of the type described above are so called "pick-up" trucks having an open bed surrounded by parallel sides and a pivoted tailgate which extends lateral to the direction of vehicle travel. It is also very desirable to permit part-time employees having trucks of this type to use signage which may be removably attached to either the vehicle tailgate or one of the sides.

SUMMARY OF THE INVENTION

The present invention contemplates an apparatus and related method for removably mounting an advertising sign to a vertical panel of a truck, and comprises a rigid aerodynamic member having a leading edge, a trailing edge and side surfaces between the edges, with the side surfaces tapering rearwardly to the trailing edge. Means are provided for removably attaching the aerodynamic member to a truck, for example the side or tailgate, and with at least one of the side surfaces defining an area to which an advertising medium can be affixed.

The aerodynamic member has a longitudinal dimension between the edges and lateral dimensions between the side surfaces, in which the longitudinal dimension is substantially greater than the lateral dimensions in order to enhance the aerodynamic characteristics of the member. It is also preferred that the longitudinal dimension extend generally parallel with the direction of vehicle travel.

Suitably, the attaching means includes an upstanding brace which extends into the aerodynamic member, and is rigidly fixed with a mount having a lateral hook portion dimensioned to pass across the top of the truck tailgate or side, and means (such as clamping screws) for releasably attaching the mount and the upstanding brace assembly across the truck tailgate or side. The mount is formed of either a plastic material or suitable metal.

The rigid aerodynamic member preferably comprises a hollow, unitary member of a molded plastic sheet, with the leading edge forming an enclosed curved surface across the front of the aerodynamic member.

In use, the brace suspends the aerodynamic member above and out of contact with the truck, and is removably attached to the truck only across the hook portion of the mount. The enclosed form of the aerodynamic member permits the use of lights within its hollow enclosure, while the enclosed nature of the aerodynamic member protects the lighting fixtures from moisture during use.

THE DRAWING

Figure 1:
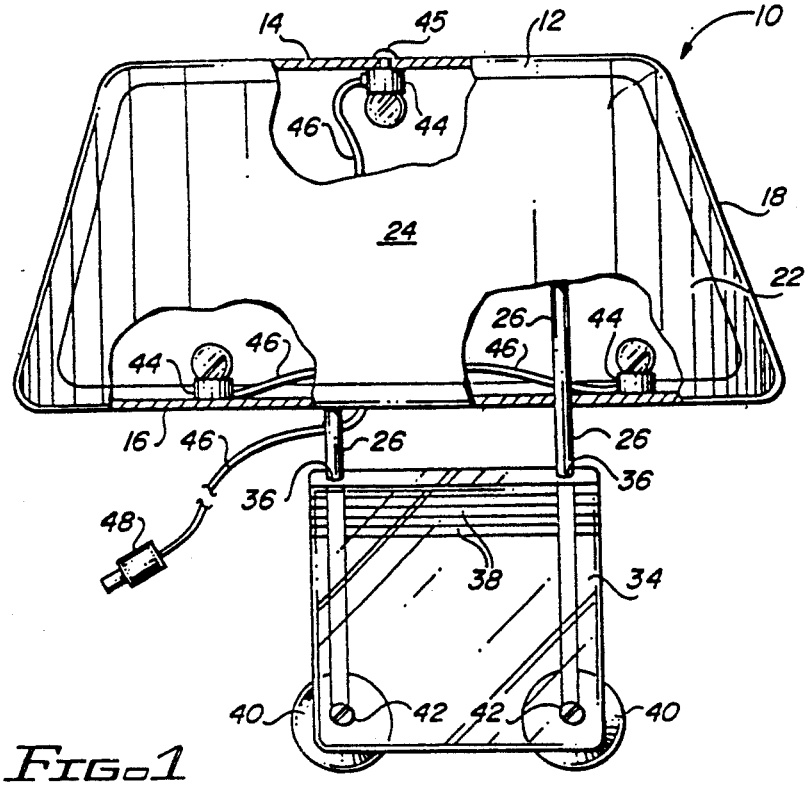
FIG. 1 is a side elevation of one form of a removable advertising sign in accordance with the present invention.
Figure 3:
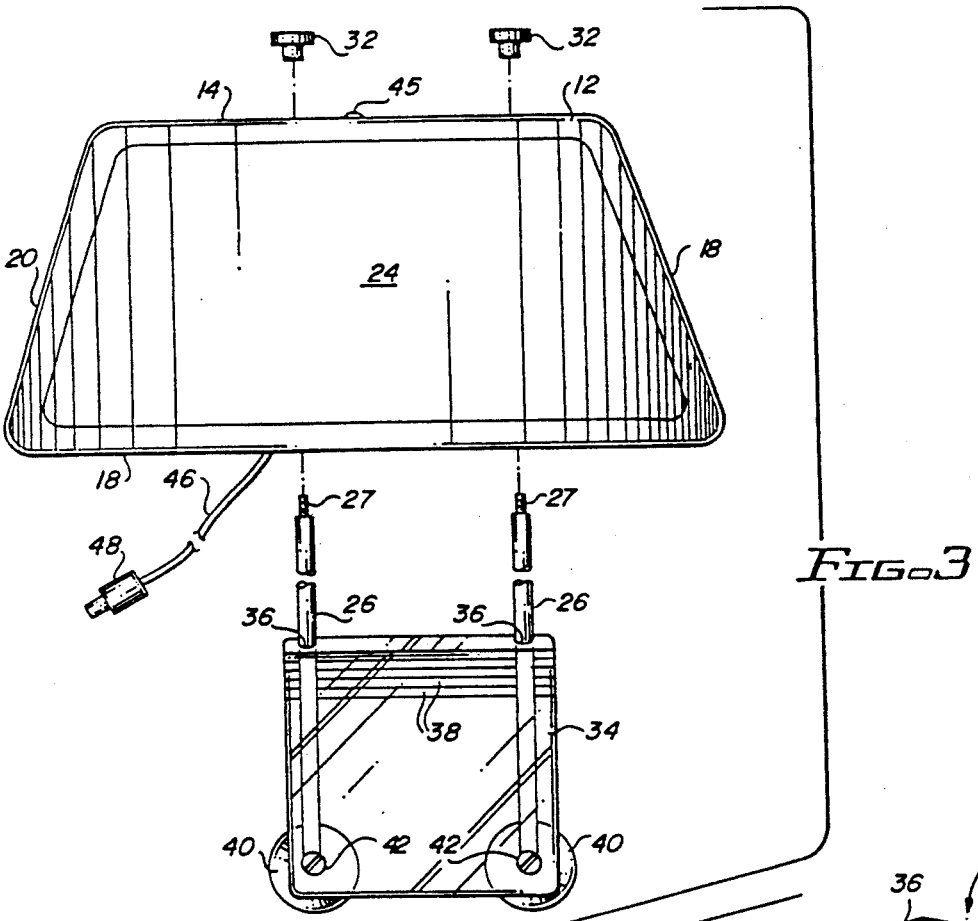
FIG. 3 is an exploded side elevation of the advertising sign shown in FIG. 1, a portion of which is shown cut away to illustrate the internal lighting system.
Figure 4:
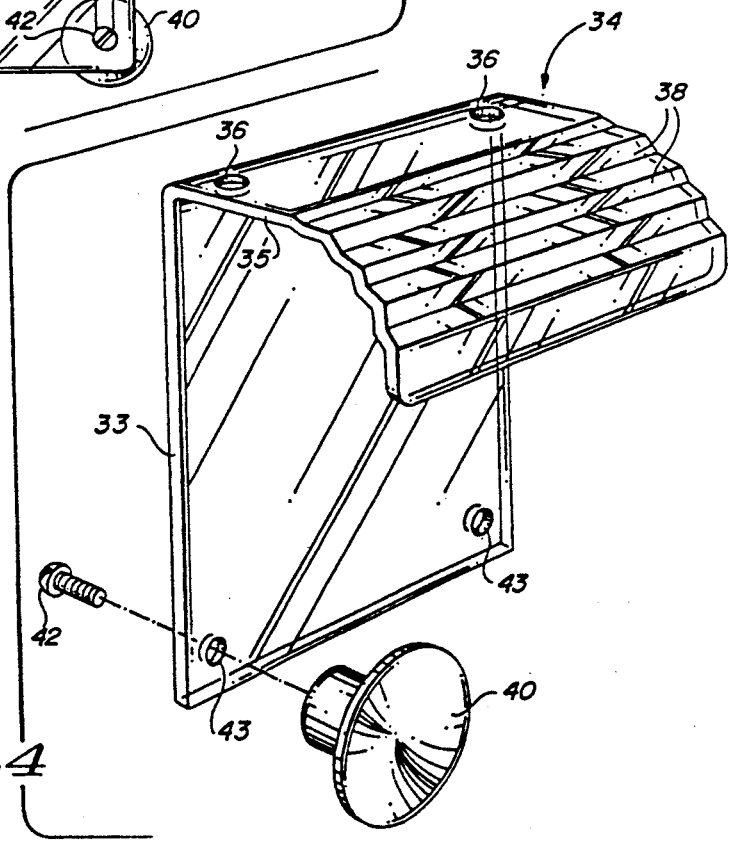
FIG. 4 is a perspective, exploded view of a portion of the advertising sign shown in FIGS. 1 and 3.
Figure 5A:
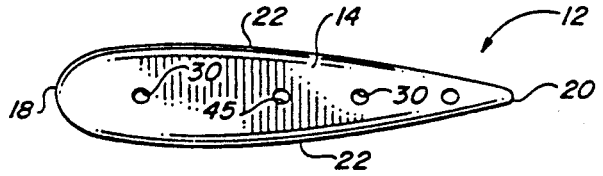
Figure 5B:
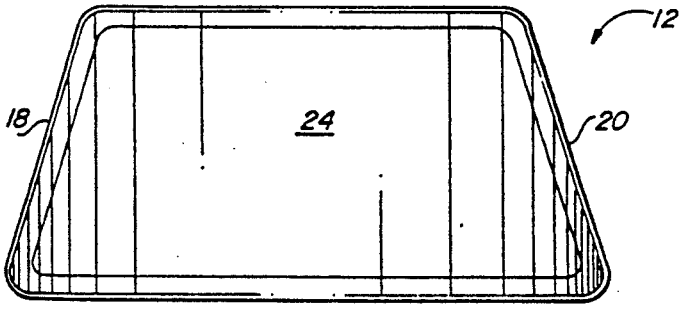
Figure 5C:
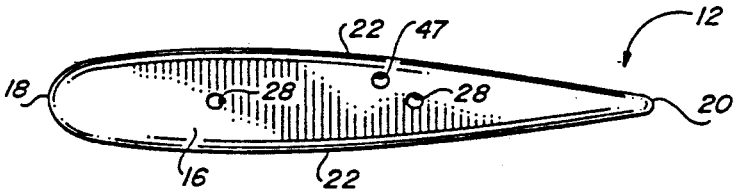

FIGS. 5A–C are top, side and bottom views, respectively, of the rigid aerodynamic member which forms a part of the advertising sign shown in FIGS. 1 and 3.

Figure 6A:
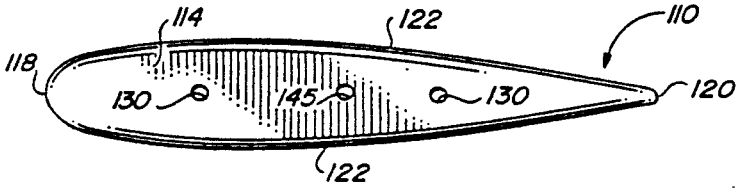
Figure 6B:
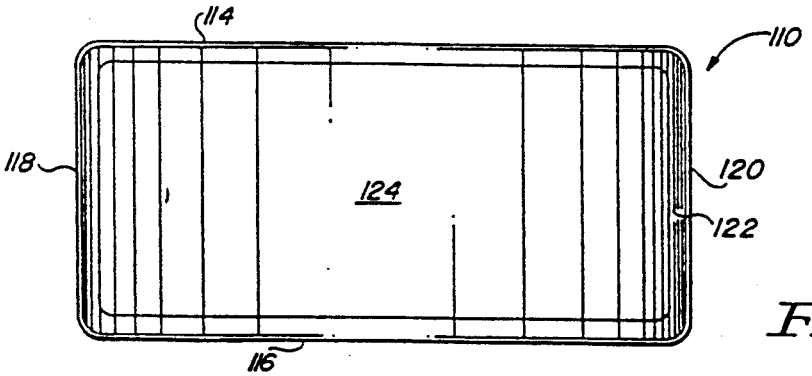
Figure 6C:
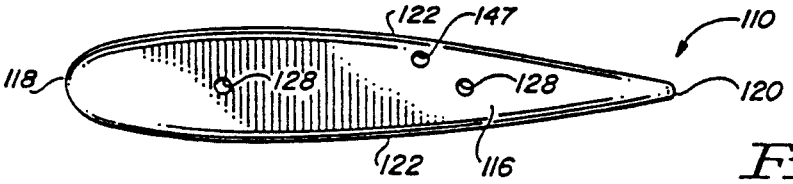

FIGS. 6A–C are top, side and bottom views, respectively, of an alternate form of the rigid aerodynamic member useful in the advertising sign of the present invention.

Figure 7:
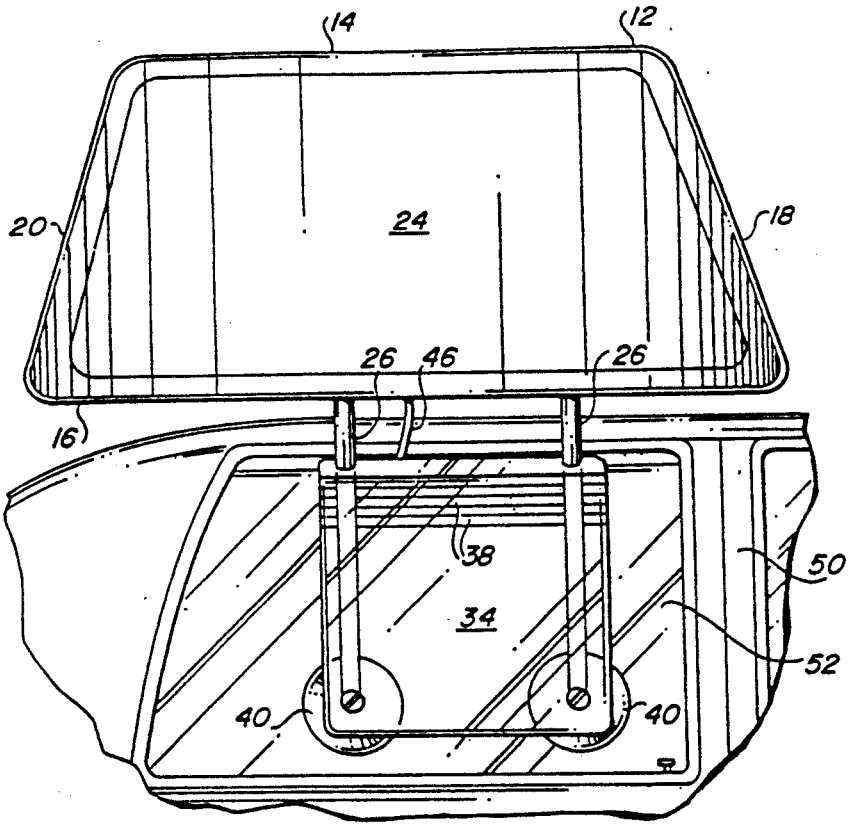
Figure 8:
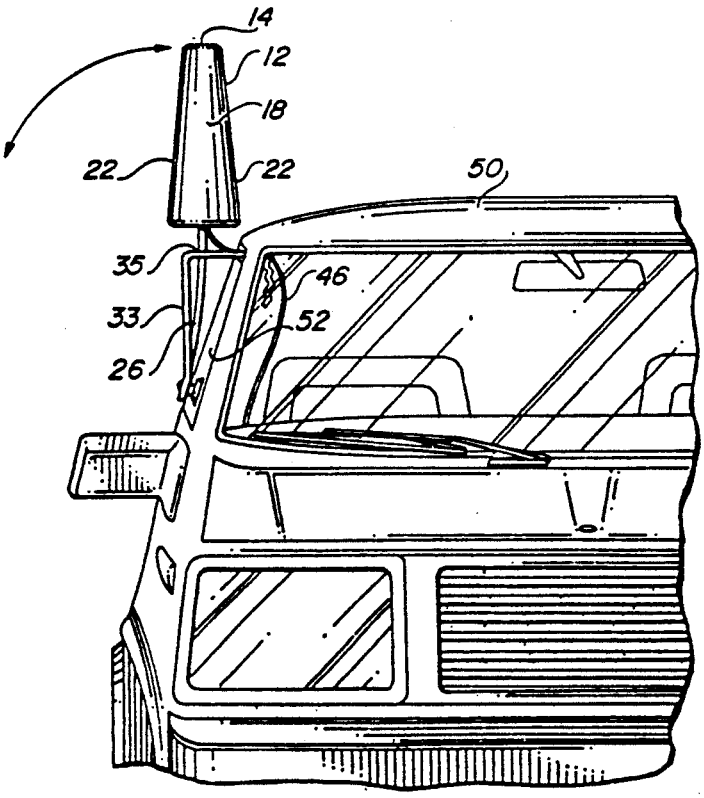

FIGS. 7 and 8 are side and front views, respectively, illustrating the manner in which the advertising sign of the present invention is used.

Figure 9:
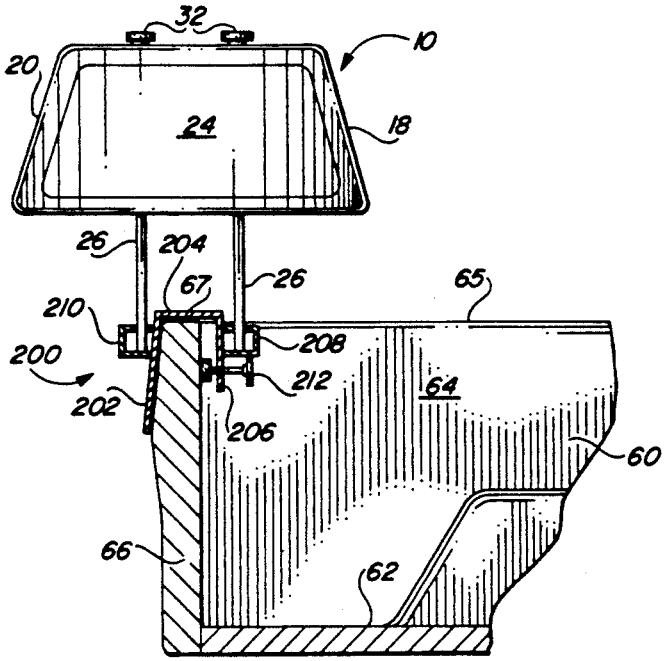

FIG. 9 is a side view, partially in cross section and partially cut away, of a pick-up truck having a removable sign attached to the tailgate in accordance with the present invention.

Figure 10:
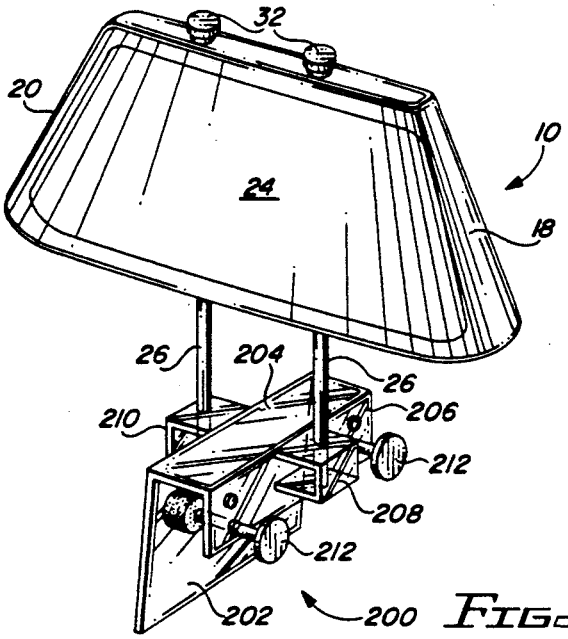

FIG. 10 is a perspective view of the removable sign shown in FIG. 9.

Figure 11:
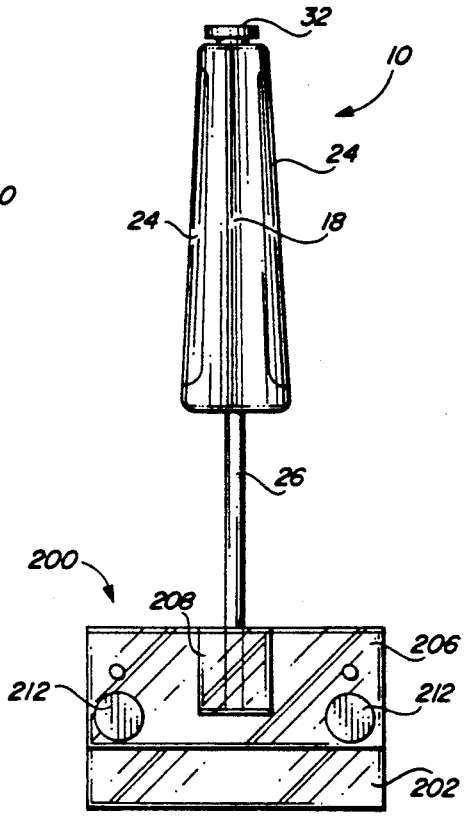

FIG. 11 is a front elevation of the removable sign shown in FIGS. 9 and 10.

Figure 12:
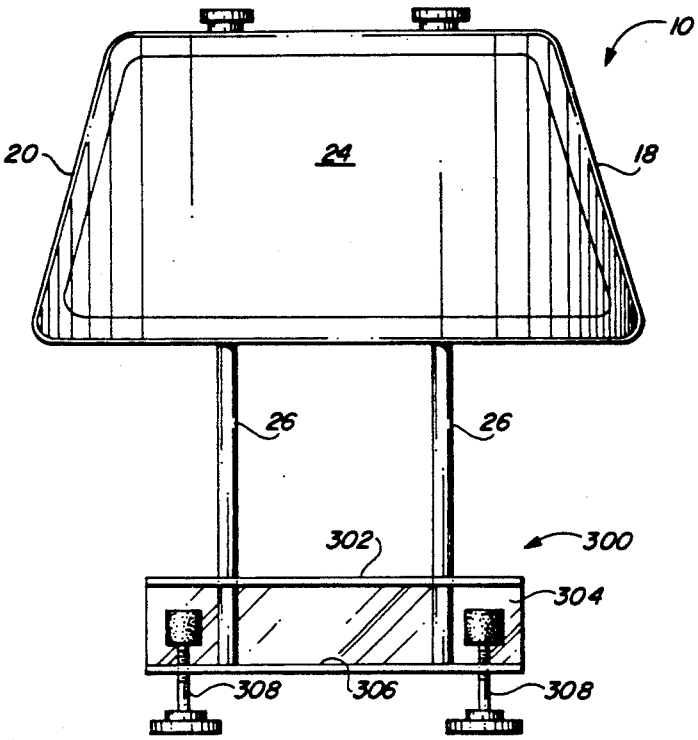

FIG. 12 is a side elevation of an alternate form of a removable sign in accordance with the present invention.

Figure 13:
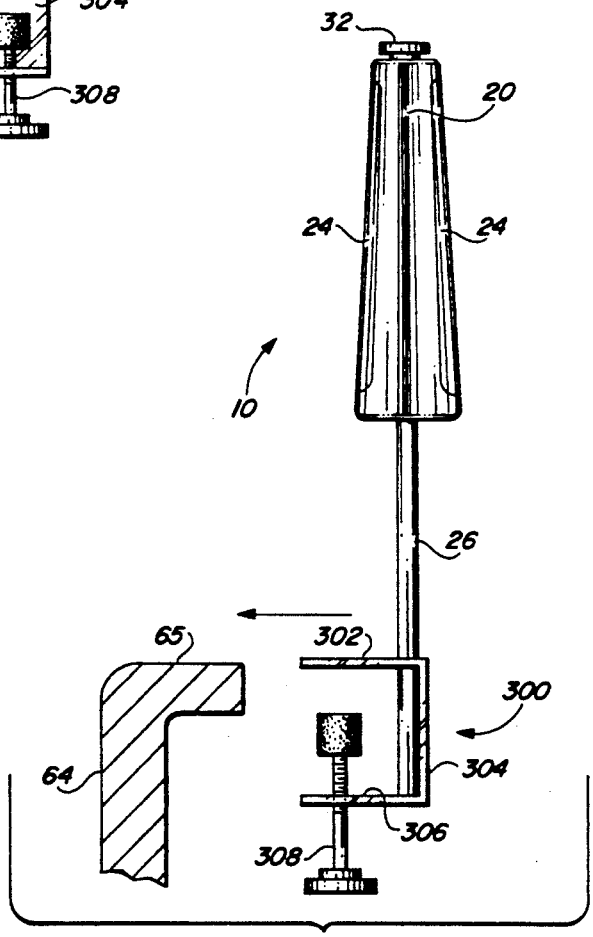

FIG. 13 is a front elevation of the sign shown in FIG. 12, and illustrating the manner in which the sign is attached to a side of a pick-up truck, shown in partial cross section.

DETAILED DESCRIPTION

The preferred embodiment of the present invention will now be described with reference to FIGS. 1, 3, 4, 5A–C, 7 and 8, where the removable advertising sign of the present invention is referred to generally by the reference numeral 10.

The advertising sign 10 comprises an enclosed, rigid aerodynamic member 12 having a top surface 14, a bottom surface 16, a curved leading edge 18 and a curved trailing edge 20. The opposing sides 22 of the rigid aerodynamic member 12 form surfaces 24 upon which advertising messages may be placed. Preferably, the rigid aerodynamic member is formed of a unitary, hollow molded plastic sheet and has a longitudinal dimension between the leading and trailing edges 18, 20 and a lateral dimension between the sides 22, and in which the longitudinal dimension is substantially greater than the lateral dimension. As is shown in FIGS. 5A and 5C, the lateral dimension varies from a wider dimension adjacent the leading edge to a narrow dimension adjacent the trailing edge. In the form of the aerodynamic member shown in FIGS. 5A–5C, the leading and trailing edges 18, 20 are tapered upwardly, so that the top surface 14 is smaller than the bottom surface 16. In the form of the aerodynamic member 116 shown in FIGS. 6A–6C, the leading and trailing edges 118 and 120 are parallel, and thus the top surface 114 and the bottom surface 116 are of the same dimension. (In FIGS. 6A–6C, the reference numerals are the same as those used in FIGS. 5A–5C, except that the reference numerals are preceded with the numeral "1").

The construction of the hollow, enclosed and rigid aerodynamic members 10, 110, as shown in FIGS. 5A–5C and FIGS. 6A–6C, respectively, provide an aerodynamic configuration which has a minimum of wind drag when mounted upon a vehicle. As can be seen, the shape of the aerodynamic members 10, 110 are somewhat similar to an aircraft wing, in order to reduce drag, but of course are mounted in a vertical, rather than horizontal direction when in use.

Referring again to FIGS. 3, 4 and 5A–C, the aerodynamic member 12 is supported upon a mounting bracket 34 by vertical braces 26, which extend through openings 28 in the bottom 16 of the member 12, and are attached via fasteners 32 through openings 30 in the top 14 of the member 12. The window mount 34 (FIG. 4) includes a vertical portion 33 and a generally horizontal hook portion 35, the hook portion 35 including a plurality of graduated steps, or corrugations, 38 which step downwardly so as to permit the mount 34 to be positively engaged with a raised window, as described in greater detail below. The mount 34 includes apertures 36 for receiving the braces 26, and a pair of openings 43 through which a fastener 42 is extended to engage a suction cup 40, the suction cup permitting removable attachment to a window, as shown in FIG. 7. The mount 34 is preferably formed of a transparent plastic material, such as plexiglass or LEXAN.

As shown in FIGS. 3 and 5C, lighting fixtures 44 are included within the aerodynamic member 12, and are coupled to a plug 48 via electric wire 46. The plug may be removably engaged into a conventional automobile cigarette lighter in order to illuminate the sign 10. The lighting fixture 44 is attached to top 14 of the aerodynamic member 12 with a fastener 45, and the electric wire exits the rigid aerodynamic member 12 via an opening 47 in the bottom 16.

Figure 2:
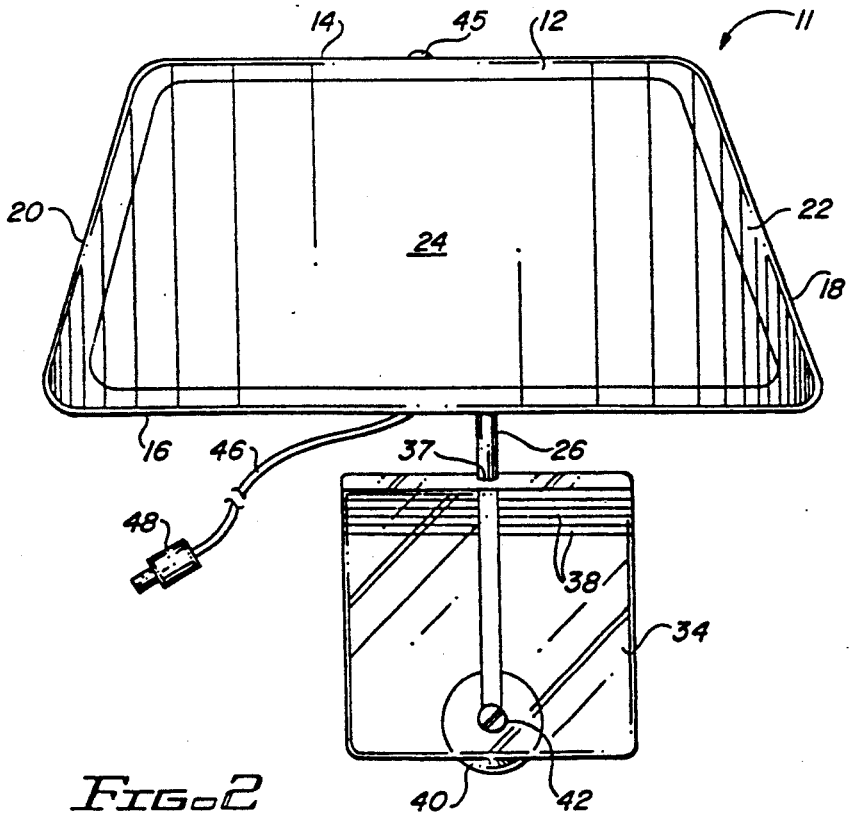
FIG. 2 is a side elevation of an alternate form of the advertising sign shown in FIG. 1.

An alternate form of the advertising sign is shown in FIG. 2 and referred to generally with the reference numeral 11. The advertising sign 11 of FIG. 2 is essentially identical to the advertising sign 10 in FIG. 1, except that the sign 11 is supported by a single vertical brace 26 extending through a single opening 37 along the hook portion 35 of the mount 34. It will be appreciated by those skilled in the art that the sign 11 may be firmly attached to the brace 26, or alternatively may be loosely attached to that brace, so that the rigid aerodynamic member 12 rotates from side to side depending upon prevailing air currents across the leading edge 18 and the sides 22.

The manner in which the advertising sign 10 is removably mounted upon an automobile window will now be described with reference to FIGS. 7 and 8. As there shown, the mount 34 is fixed to the window by extending the hook portion 35 through the window, permitting the graduated steps 38 to extend through the window and be positively engaged by the bottom of the window, after it is raised. The suction cups 40 removably engage the outside surface of the window 52 of the vehicle 50. The electrical wire 46 is extended through the partially opened window 52, and the plug 48 is engaged in the cigarette lighter of the vehicle 50. As will be appreciated from the front elevation of FIG. 8, the graduated steps of the hook portion 35 permit the angular displacement of the advertising sign 10, thus permitting adjustment to account for different angular displacements for different automobile windows.

An aerodynamic sign having means for permitting easy installation and removal onto a delivery pick-up truck is illustrated in FIGS. 9–11.

In FIG. 9, a portion of a conventional pick-up truck 60 is shown broken away and in cross section, and includes a bed 62 which is attached to the truck cab (not shown) in a conventional manner, and further includes a side panel 64 and a tailgate 66.

In accordance with the present invention, the aerodynamic member 10 shown and described previously with reference to FIGS. 1–8 is rigidly attached to a removable mounting bracket 200. As described previously, the aerodynamic member 10 includes a leading surface 18, a trailing surface 20 and opposing advertising sides 24. The sign includes a pair of spaces braces 26 which extend vertically through the sign and removably attached by fasteners 32.

The mounting bracket 200 includes a bracket member assuming a generally U- or J-shape including opposing and spaced bracket sides 202 and 206, and horizontal bridging member 204. Threaded clamping members 212 extend through the inner side 206 and bear against the inside surface of the tailgate 66 in order to permit the attachment and removal of the mounting bracket 200, and thus the aerodynamic sign member 10.

In accordance with this invention and as has been described above with reference to the embodiments of FIGS. 1–8, the brace members 26 are spaced apart a dimension sufficient to insure the rigidity of the aerodynamic advertising member 10 while the truck 60 is underway. In order to achieve sufficient dimension between the braces 26, the mounting bracket 200 is provided with lateral brace attachment members 208, 210 extending inwardly and outwardly from the mounting bracket 200.

Another embodiment of a removable truck-mounted sign attachable to the side 64 is shown in FIGS. 12 and 13. In this embodiment, the C- or J-shaped mounting bracket, referred to generally by the reference numeral 300, extends in a longitudinal direction and is formed of opposing sides 302, 306 which are adapted to extend horizontally, and a vertical bridging member 304 between the two. Adjustable threaded clamping members 308 extend through the side 306 and bear against the side 64 of the truck 60.

In the embodiment of FIGS. 9–11, it will be understood that the horizontal bridging member 204 is in engagement with the horizontal top surface 67 of the tailgate 66, while in the embodiment of FIGS. 12 and 13, the horizontal side 302 is in engagement with the top horizontal surface 65 of the truck side 64.

This concludes the description of the preferred embodiments. A reading by those skilled in the art will bring to mind various changes without departing from the spirit and scope of the invention. It is intended, however, that the invention only be limited by the following appended claims.

What is claimed is:

1. Apparatus for removably mounting an advertisement to a trunk having a vertical panel, such as a vertical tailgate or a vertical side, comprising:

an aerodynamic member having a leading surface, a trailing surface and advertising spaces between those surfaces, the member having a longitudinal dimension between the surfaces and lateral dimensions between the advertising spaces with the longitudinal dimension being substantially greater than the lateral dimensions;

a unitary mounting means including upstanding brace means for releasably attaching the aerodynamic member to a vertical panel of a trunk with the advertising spaces extending generally vertically, the mounting means including a portion dimensioned to pass across a top surface of a vertical panel of a truck;

the upstanding brace means rigidly joined with the mounting means at spaced points and joined with the aerodynamic member at spaced points, so as to prevent rotation of the aerodynamic member and maintain the longitudinal dimension extending in a predetermined direction.

2. The apparatus recited in claim 1 wherein the lateral dimensions vary from the leading surface to the trailing surface in an aerodynamic configuration.

3. The apparatus recited in claim 1 wherein the aerodynamic member has an upper surface and a lower surface, the upper and lower surfaces extending between the leading and trailing surfaces, and wherein the brace means is coupled to the lower surface.

4. The apparatus recited in claim 1 wherein the mounting means has a generally U-shaped configuration, and is dimensioned to fit across a vertical panel of a truck.

5. The apparatus recited in claim 4 wherein the mounting means comprises means for positively clamping to a vertical panel of a truck.

6. The apparatus recited in claim 5 wherein the positive clamping means comprises plural clamping screws dimensioned to extend across the U-shaped mounting means and into engagement with a vertical panel of a truck.

7. The apparatus recited in claim 1 wherein the upstanding brace extends through and is rigidly joined with the mounting means.

8. The apparatus recited in claim 7 wherein the mounting means comprises brace attachment members engaging the brace means.

9. The apparatus recited in claim 1 wherein the aerodynamic member comprises a hollow plastic member.

10. The apparatus recited in claim 9 wherein the leading surface is enclosed.

11. In combination:

a truck having a tailgate extending generally lateral to the direction of travel and a side extending generally parallel to the direction of travel;

an advertising member having an enclosed leading surface, an enclosed trailing surface and enclosed side surfaces between the leading and trailing surfaces, the member defining a longitudinal dimension between the leading and trailing surfaces;

a unitary mounting unit removably attached to either the tailgate or the side;

upstanding brace means extending through the mounting unit and joined with the member, the upstanding brace means rigidly joined with the mounting unit at spaced points and joined with the member at spaced points, so as to prevent rotation of the member and maintain the longitudinal dimension extending in a direction generally parallel with the direction of truck travel; and wherein the side surfaces form an area upon which an advertising medium can be fixed for display in a direction lateral to the direction of travel.

12. In configuration:

a motor vehicle having a generally vertical panel;

an aerodynamic member having a leading surface, a trailing surface and side surfaces, the member having a longitudinal dimension between the leading and trailing surfaces and lateral dimensions between the side surfaces, the longitudinal dimension being substantially greater than the lateral dimensions;

means for releasably attaching the aerodynamic member to the generally vertical vehicle panel with the side surfaces extending generally vertically, the attaching means including a unitary mount having a portion dimensioned to pass across the top of, and engage the vehicle panels, the attaching means further including an upstanding bracket means;

the upstanding brace means rigidly joined with the mount at spaced points and joined with the aerodynamic member at spaced points, so as to prevent rotation of the aerodynamic member and maintain the longitudinal dimension extending in a direction generally parallel with the direction of vehicle travel; and wherein at least one of the side surfaces defines an area to which an advertising medium can be affixed.

* * * * *